United States Patent [19]

Mays et al.

[11] Patent Number: 4,713,134

[45] Date of Patent: Dec. 15, 1987

[54] DOUBLE BELT BONDING OF FIBROUS WEB COMPRISING THERMOPLASTIC FIBERS ON STEAM CANS

[75] Inventors: Alfred T. Mays, East Windsor; Nicholas Wereson, Spotswood, both of N.J.

[73] Assignee: Chicopee, New Brunswick, N.J.

[21] Appl. No.: 771,138

[22] Filed: Aug. 28, 1985

Related U.S. Application Data

[63] Continuation of Ser. No. 608,253, May 7, 1985, abandoned.

[51] Int. Cl.[4] ..... D04H 3/08

[52] U.S. Cl. ..... 156/181; 156/311; 156/498; 156/583.5

[58] Field of Search ..... 156/296, 311, 583.5, 156/498, 181

[56] References Cited

U.S. PATENT DOCUMENTS

| | | | |
|---|---|---|---|
| 1,519,239 | 12/1924 | Clay | 156/311 |
| 3,442,720 | 5/1969 | David | 156/311 |
| 3,671,365 | 6/1972 | Cover et al. | 156/311 |
| 4,410,385 | 10/1983 | Murphy et al. | 156/181 |

FOREIGN PATENT DOCUMENTS

| | | |
|---|---|---|
| 1189851 | 4/1970 | United Kingdom . |
| 1237603 | 6/1971 | United Kingdom . |

*Primary Examiner*—Jay H. Woo
*Assistant Examiner*—Timothy W. Heitbrink

[57] ABSTRACT

Method and apparatus for producing a fabric from a fibrous web comprising at least 5 percent thermoplastic fibers, said method comprising superimposing the web on a first carrier belt, superimposing a second carrier belt on the web, causing the web and belts to travel about at least two heated rolls, and cooling the web between the belts.

3 Claims, 1 Drawing Figure

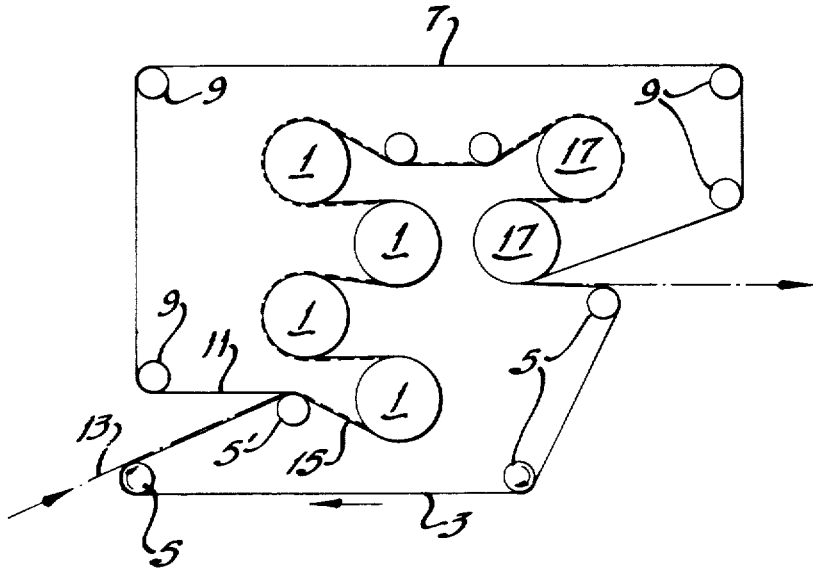
7
9
9
1
17
1
17
9
11
1
5
1
13
5
15
5
3

DOUBLE BELT BONDING OF FIBROUS WEB COMPRISING THERMOPLASTIC FIBERS ON STEAM CANS

This application is a continuation of application Ser. No. 608,253 filed May 7, 1985.

BACKGROUND OF THE INVENTION

Method and apparatus for drying and heat setting fibrous webs about steam cans are known. The method involves utilizing a carrier belt to carry the web in a serpentine pattern about a series of steam cans. The method and apparatus may also utilize cooling cans about which the web is subsequently carried. The prior art encompasses many variations in the above method and apparatus. U.S. Pat. No. 1,519,239 to Clay discloses a molding apparatus for fibrous sheet material. The fibrous sheet is passed around and between a series of pressure rollers. The initial pressure roller nip is heated and subsequent pressure roller nips may be cooled. Endless carrier belts are provided to move the fibrous sheet material through and around the pressure rollers.

U.S. Pat. No. 3,671,365 to Cover Jr., et al., discloses an apparatus for compressing and cooling a fibrous web. The fibrous web is fed between an upper series and a lower series of rollers comprising the compression frame. A carrier belt is mounted about each of the upper and lower series of rollers. U.S. Pat. No. 3,442,740 to David, discloses a process and apparatus which comprises a modification of the palmer dryer and method used to dry and heat fibrous webs. The palmer dryer comprises a heated roll and a flexible endless belt which travels around the roll. A web is fed between the belt and the roll, and travels about the roll while under the belt. In the modification described in the David patent, the web is doffed from the heating roll and travels around another cooling roll or drum. In the method of the present invention, the fibrous web is maintained between two belts as the belts travel about spaced heated cans and optionally thereafter spaced cooling cans.

SUMMARY OF THE INVENTION

The present invention comprises a method and apparatus for producing a fabric from a fibrous web comprising at least 5 percent thermoplastic fibers including conjugate fibers. The method comprises the steps of superimposing a fibrous web comprising thermoplastic fibers on a first carrier belt, superimposing a second carrier belt on the webs causing said two belt laminate to travel around spaced heated rolls, causing said thermoplastic fibers to fuse and bond to fibers in the web; and maintaining the web between the two belts until the fibers are cooled. Low shrink thermoplastic fibers may be used, or alternatively, tension may be applied to the web through the belts to prevent substantial shrinkage of the web. Optionally, the fibers may be cooled by passing the web and two belts about spaced cooling cans. The thermoplastic fibrous material formed by the apparatus and method of the present invention have excellent cross directional strength.

BRIEF DESCRIPTION OF THE DRAWINGS

The FIGURE is a schematic side view of the method according to the present invention.

DESCRIPTION OF THE DRAWINGS

The present invention utilizes a series of spaced heated rolls, such as the steam cans currently used to bond and heat set fibrous webs, in a new and unique process for producing a fabric containing thermoplastic fibers. The heated rolls or steam cans depicted at 1 in FIG. 1 are rotatably mounted to a frame (not shown). The rolls or cans are spaced from each other, and in no way provide a compression nip. A first endless carrier belt 3, is wound about means 5, for causing said first belt to travel in a serpentine path about the rolls. A second endless carrier belt 7, is wound about means 9, for causing the second belt to travel along an initial path 11, spaced from said first belt, and then along said serpentine path about the rolls. Means 5' may be adjusted to impart different degrees of tension to the belts, lower tension yielding higher bulk fabrics and higher tension giving rise to less shrinkage. First and second carrier belts may be formed of, for example, polyester, stainless steel, teflon coated fiberglass, teflon, or bronze. The belts may vary in construction from, e.g., a 40×40 mesh to a substantially non-porous configuration. The belts preferably have good release properties, e.g., the teflon and teflon coated fiberglass belts. Another useful property in the belt is good heat transmission as exhibited by belts of bronze and stainless steel.

According to the method of the present invention, a web 13 comprising, e.g., low shrink thermoplastic fibers may be superimposed on said first carrier belt and the second carrier belt is superimposed on said web forming a two belt laminate 15 just prior to or as the belts begin to travel about the rolls. The rolls, which may be heated by any suitable means, melt and fuse the thermoplastic fibers to fibers in the web. The fibrous web is maintained between the two belts as it is removed from the last in the series of rolls and is maintained between the belts until the web cools. To facilitate cooling of the web, the belts may be passed around at least one cooling roll as shown in FIG. 1 at 17. The cooling rolls are also spaced and in no way comprise a compression nip.

The present method and apparatus may utilize existing steam cans as the heated rolls used to fuse the low shrink thermoplastic fibers to form a fibrous material. By maintaining the web between the belts until the web is cooled, the method avoids the loss in cross directional strength due to drafting as a web is removed from a roll on one carrier belt. Also the use of two belts prevents sticking of the heated thermoplastic fibers of the web to the rolls and permits rapid handling of the web while heated, including immediately passing the web about cooling rolls. Low shrink thermoplastic monofils such as Eastman 4BC crystalline copolyester fibers may be used in the present invention, however, sheath/core polyethylene/polyester conjugate fibers are preferred. The conjugate fibers may be eccentric, symmetrical sheath/core or side by side by side. Polyethylene/polypropylene conjugate fibers may also be used. In all cases, means 5' may be used to adjust the tension and reduce shrinkage.

The foregoing description and drawing are illustrative but are not to be taken as limiting. Other variations and modifications are possible without departing from the spirit and scope of the present invention.

We claim:

1. A method of producing a high cross directional strength fused nonwoven fabric comprising thermoplastic fibers, said method comprising:

(a) superimposing a fibrous web comprising at least 5 percent thermoplastic fibers on a first endless carrier belt;

(b) superimposing a second endless carrier belt on said web so as to form a two belt laminate with said web sandwiched between the first and second endless carrier belts;

(c) directing said two belt laminate to travel in a path consecutively around substantial portions of first and second heated rolls, which are offset from each other and spaced apart a sufficient distance to avoid a compression nip between said first and second heated rolls, the peripheral surfaces of said first and second heated rolls cooperating to provide a portion of said path whereby said two belt laminate travels out of contact with said first and second heated rolls, so as to initially apply heat to a first side of said web as said two belt laminate is directed around said first heated roll and thereby fuse the thermoplastic fibers to fibers adjacent the first side thereof and to thereafter apply heat to a second side of said web as said two belt laminate is directed around said second heated roll and thereby fuse the thermoplastic fibers to fibers adjacent the second side thereof; and (d) cooling the two belt laminate after it has traveled around the first and second heated rolls so as to cool the fibers in the web sandwiched between the first and second endless carrier belts.

2. Apparatus for forming a high cross directional strength nonwoven fabric comprising thermoplastic fibers, said apparatus comprising:

(a) a frame;

(b) first and second heated rolls rotatably mounted to said frame in offset relationship to each other, said rolls being spaced apart a sufficient distance to avoid a compression nip between said first and second rolls;

(c) a first endless carrier belt means mounted to said frame for travel in a path consecutively around substantial portions of said first and second heated rolls;

(d) a second endless carrier belt means mounted to said frame for travel along said path around substantial portions of said first and second heated rolls adjacent to said first belt means;

(e) means for superimposing a fibrous web, comprising at least 5 percent thermoplastic fibers, onto said first belt means so that said first and second belts form a two belt laminate with said web sandwiched therebetween, said two belt laminate being caused to travel in said path consecutively around a substantial portion of said first heated roll to initially apply heat to a first side of said web and thereby fuse the thermoplastic fibers to fibers adjacent the first side thereof and then around a substantial portion of said second heated roll to apply heat to a second side of said web and thereby fuse the thermoplastic fibers to fibers adjacent the second side thereof;

(f) the peripheral surfaces of said first and second heated rolls cooperating to provide a portion of said path whereby said two belt laminate travels out of contact with said first and second heated rolls; and (g) cooling means for cooling said two belt laminate after it has travelled around said first and second heated rolls to cool the fibers in the web sandwiched between said first and second endless carrier belts.

3. An apparatus as in claim 2 wherein said means for cooling comprises at least one cooled roll.

* * * * *

UNITED STATES PATENT AND TRADEMARK OFFICE

CERTIFICATE OF CORRECTION

PATENT NO. : 4,713,134

DATED : December 15, 1987

INVENTOR(S) : Alfred T. Mays et al.

It is certified that error appears in the above-identified patent and that said Letters Patent is hereby corrected as shown below:

Title page:

under heading "RELATED U.S. APPLICATION DATA"

after "Continuation of Ser. No. 608,253, May 7, 1985, abandoned,"

please insert --Continuation of Ser. No. 430,308, September 30, 1982, abandoned.--

Signed and Sealed this

Twenty-eighth Day of June, 1988

*Attest:*

*Attesting Officer*

DONALD J. QUIGG

*Commissioner of Patents and Trademarks*